US005305925A

United States Patent [19]

Vogel

[11] Patent Number: 5,305,925

[45] Date of Patent: Apr. 26, 1994

[54] DISPOSABLE PRESSURE CONTAINER, IN PARTICULAR FOR USE AS A REFILL CONTAINER FOR REFRIGERATING AND AIR CONDITIONING SYSTEMS

[75] Inventor: Guenter M. Vogel, Munich, Fed. Rep. of Germany

[73] Assignee: Hago-Chemotechnik GmbH & Co. KG, Munich, Fed. Rep. of Germany

[21] Appl. No.: 916,005

[22] PCT Filed: Sep. 10, 1991

[86] PCT No.: PCT/EP91/01723

§ 371 Date: Jul. 30, 1992

§ 102(e) Date: Jul. 30, 1992

[87] PCT Pub. No.: WO92/06019

PCT Pub. Date: Apr. 16, 1992

[30] Foreign Application Priority Data

Oct. 2, 1990 [DE] Fed. Rep. of Germany ... 9013730[U]

[51] Int. Cl.[5] ..... B65D 47/02

[52] U.S. Cl. ..... 222/147; 222/402.1; 141/20

[58] Field of Search ..... 141/3, 20; 215/18, 25; 222/147, 402.16, 402.1, 402.14

[56] References Cited

U.S. PATENT DOCUMENTS

| | | | |
|---|---|---|---|
| 3,704,813 | 12/1972 | Devol | 222/147 |
| 4,216,884 | 8/1980 | Giuffredi | 222/402.16 |
| 4,543,980 | 10/1985 | van der Sanden | 137/315 |
| 4,573,611 | 3/1986 | O'Connor | 222/147 |
| 4,921,214 | 5/1990 | Jernberg | 251/335.2 |
| 5,018,552 | 5/1991 | Politi et al. | 222/147 |

FOREIGN PATENT DOCUMENTS

| | | | |
|---|---|---|---|
| 2559444 | 12/1976 | Fed. Rep. of Germany . | |
| 2133502 | 7/1984 | United Kingdom | 222/147 |

*Primary Examiner*—Andres Kashnikow
*Assistant Examiner*—Kenneth Bomberg
*Attorney, Agent, or Firm*—Middleton & Reutlinger

[57] ABSTRACT

A disposable pressure container is provided with a combined filling and removing valve which comprises a valve body (11) which is slidably guided in a bore of a valve housing (8) and pressed by a resilient force against a valve seat and which is liftable from its valve seat during filling and removing operations. Furthermore, the valve has a second valve body (22) which, before the container is filled for the first time, is spaced from its valve seat (16) by a surmountable and fluid-permeable barrier (17, 18). After the container has been filled, the second valve body (22) is pressed beyond barrier (17) and forms, together with its valve seat (16), a check valve which prevents container (1) from being filled anew. To produce an inexpensive valve, valve housing (8) is made integral with a first bore (10) for receiving the first valve body and a second bore (15) for receiving the second valve body (22) made of a plastic material. At the end opposite to the first valve seat (9), the first bore (10) has a radially inwardly oriented shoulder (14) which is made integral with the housing and has formed thereon projections (18) that project radially inwards into the circular plan view of the second bore (15) and are integral with the valve housing made of plastics. The first valve body (11) is supported by a helical spring (13) on shoulder (14) while projections (18) form the barrier for the second valve body (22).

19 Claims, 2 Drawing Sheets

Figure 1:
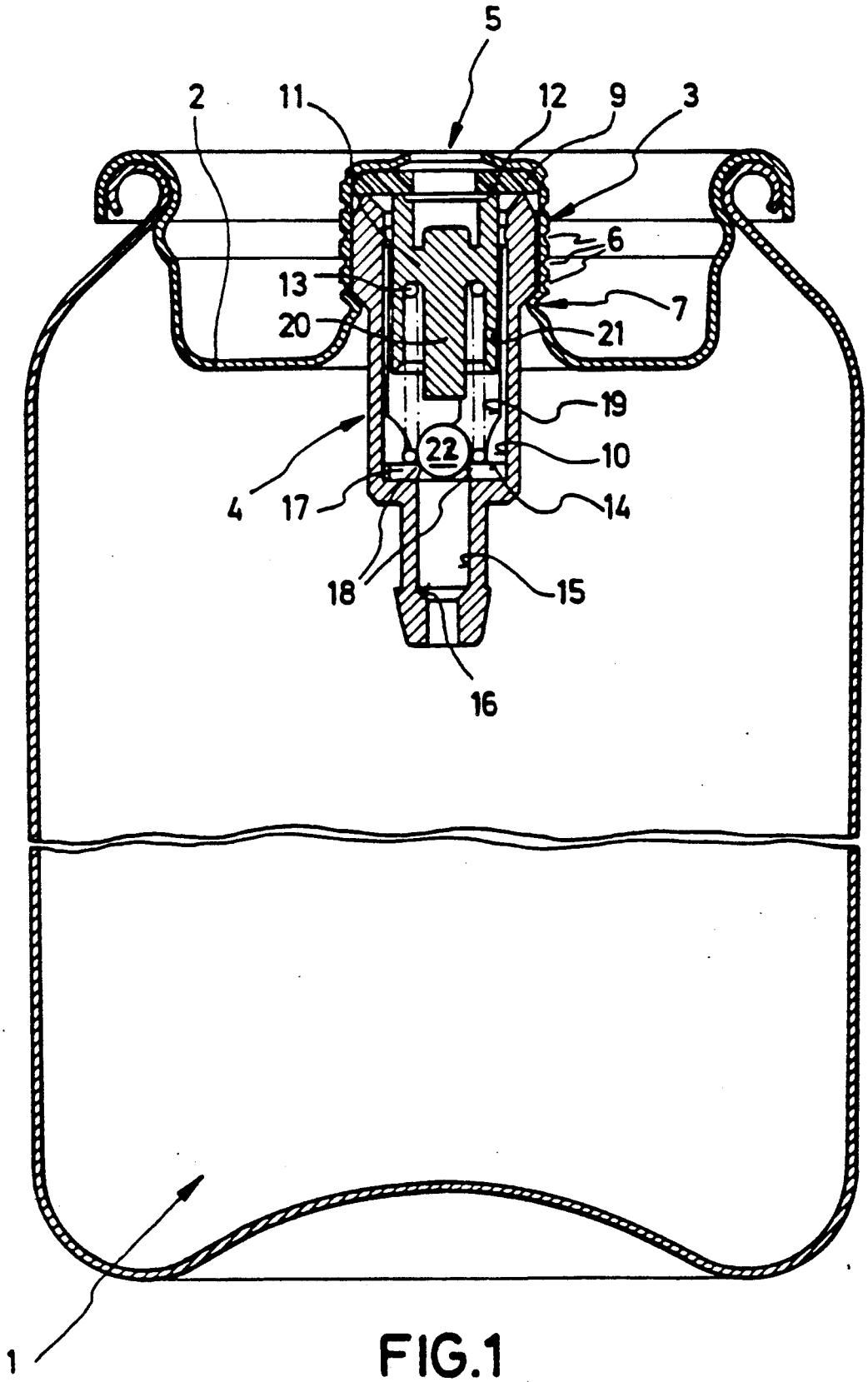

DISPOSABLE PRESSURE CONTAINER, IN PARTICULAR FOR USE AS A REFILL CONTAINER FOR REFRIGERATING AND AIR CONDITIONING SYSTEMS

This invention relates to a disposable pressure container, in particular for use as a refill container for refrigerating and air conditioning systems, comprising a combined filling and removing valve which has a filling and removing opening and includes a valve body which is displaceably guided in a bore of a valve housing and urged by a resilient force against a valve seat and which is liftable from the valve seat against the action of the resilient force for filling the pressure container and for removing the pressurized contents of the container, and which includes a second valve body which, before the container is filled for the first time, is held in space-apart relationship with its valve seat by a surmountable and fluid-permeable barrier, a tappet which is actuable from the filling and removing opening and acts on the second valve body being provided for urging the second valve body beyond the flexible barrier, whereby the second valve body forms a check valve with its valve seat after the barrier has been surmounted, the check valve preventing the container from being filled again.

Several applications are known of disposable pressure containers. The most frequent use is probably that of a sprayer for spraying products using a propellant. Pressure containers of this type are also used as gas tanks for small brazing and welding devices. Another important use is the employment thereof as a refill container for automotive air conditioning systems. Before the delivery of automotive vehicles a certain loss of refrigerants can already be observed in the per se closed circuit of the air conditioning system in most cases. This loss is compensated for by refrigerants contained in refill containers, which are fed into the air conditioning system through the filling and removing valve.

Although the law forbids the renewed filling of such disposable containers with refrigerants or propellants, the combined filling and removing valves would permit such a refilling operation. When one bears in mind that the pressure containers are damaged to some degree during their use, the refilling possibility entails a high potential safety risk.

A disposable pressure container of the above-mentioned kind is known from U.S. Pat. No. 3,704,813. This pressure container has already the advantage that it prevents refilling. However, the valve housing is relatively troublesome from a constructional point of view, and its manufacture is thus expensive.

It is therefore the object of the present invention to improve the valve housing in a disposable pressure container of the above-mentioned type in such a way that its production is easy and inexpensive.

This object is attained according to the invention in that the valve housing is made integral with a first bore for receiving the first valve body and a second bore for receiving the second valve body of plastics, that at the end opposite to the first valve seat the first bore comprises a radially inwardly oriented shoulder which is integral with the housing and on which a helical spring urging the first valve body against the first valve seat is supported on the one hand and the barrier for the second valve body is formed on the other hand, the shoulder comprising projections that project radially inwards into the circular plan view of the second bore and are also made integral with the valve housing of plastics The valve housing can thus be manufactured in a simple way as an injection-moulded part, made e.g. of polyamide, or the like. Hence, a substantial safety advantage can be achieved at very small costs The projections can be constructed in a very simple way if designed as radially inwardly positioned ends of radial webs that are arranged on the shoulder and evenly distributed over the circumference. These webs lift the second valve body from the shoulder when the container is filled for the first time, so that during the filling operation fluid can flow through passages defined by the webs into the smaller second bore and thus into the container.

In an especially preferred embodiment, the projections taper to the first larger bore when viewed from the second smaller bore. Hence, the valve body which is within the second smaller bore after the first filling operation is centered by the projections when fluid is removed from the container, whereby a uniform annular gap is formed through which fluid can flow into the larger bore.

In a preferred embodiment, the second valve body is made rotationally symmetrical and has a smaller diameter than the second bore.

Furthermore, the helical spring is preferably supported on the webs formed on the shoulder and has an inner diameter slightly greater than that of the second valve body. The helical spring thus forms a guide for the second valve body when after the first filling the second valve body is pushed with the aid of the tappet through the barrier into the second smaller bore.

In a preferred embodiment, the second valve body is a ball which is preferably made of a harder material than the projections. A preferred material for the ball is glass or steel while polyamide is preferably used for the valve housing and the projections.

Furthermore, in a constructionally and technically preferred solution, the tappet is surrounded by and in spaced-apart relationship with a collar of the first valve body, and the helical spring acts on the first valve body within the space formed between tappet and collar.

Figure 2:
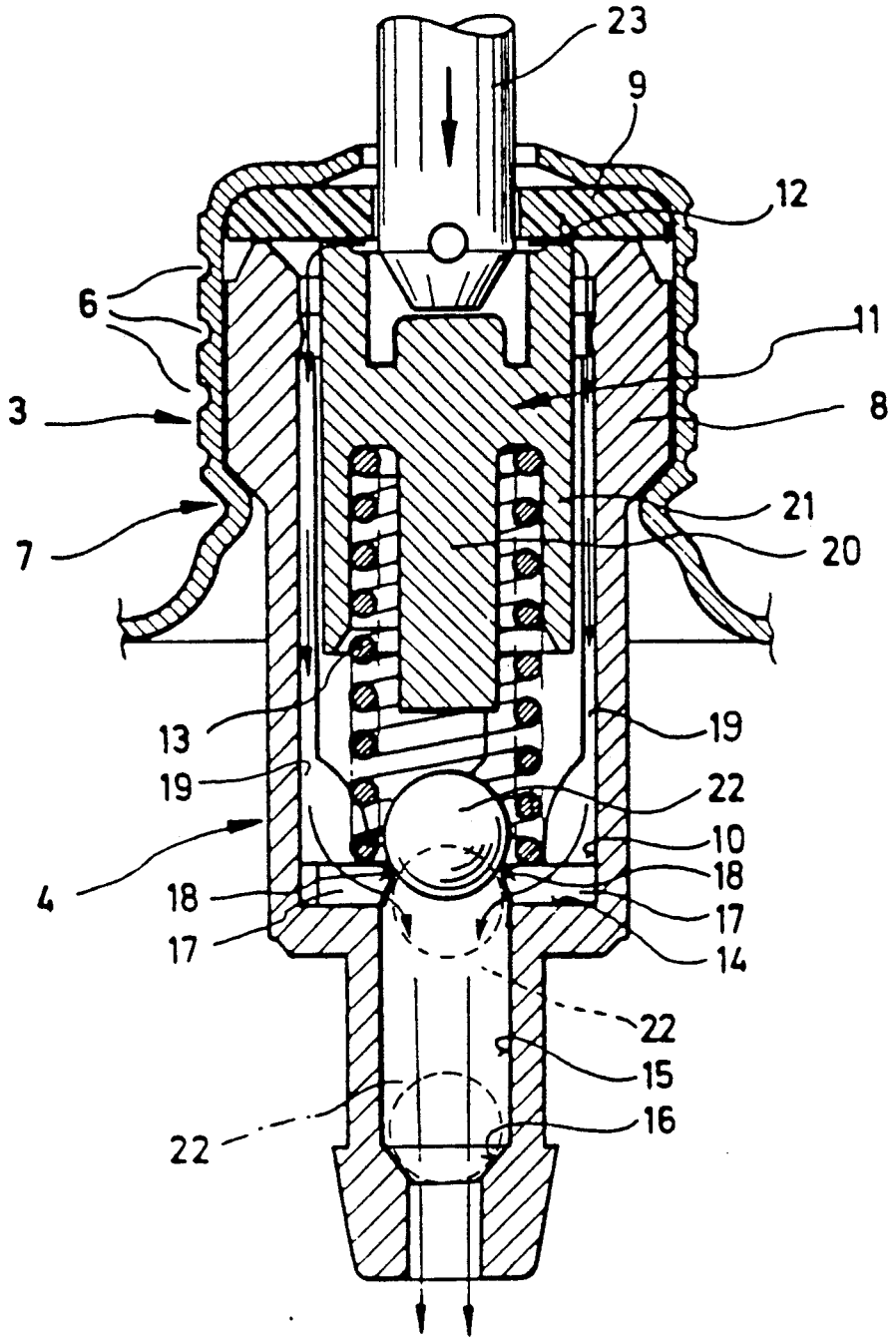

An embodiment of the invention shall now be explained in more detail with reference to the drawing, in which:

FIG. 1 is a diagrammatic sectional view of a disposable pressure container comprising a filling and removing valve in accordance with the invention; and FIG. 2 is an enlarged view of the filling and removing valve shown in FIG. 1.

FIG. 1 shows a pressure container 1 which is closed by a cover 2. Cover 2 is connected to the upper edge of container 1 by means of a flanged closure. A substantially cylindrical elevation 3 whose center is equipped with a filling and removing opening 5 is provided in the middle of cover 2. The outside of elevation 3 is equipped with a thread 6 for screwing a filling and removing head thereonto. This head is not shown for the sake of clarity. Elevation 3 encloses a filling and removing valve 4 which is gripped from behind by a surrounding embossed portion 7 and retained within elevation 3. Valve 4 comprises a valve housing 8 which is sealed by a sealing disc 9 with respect to the upper end of elevation 3. A first large bore 10 is provided within sealing housing 8 and has displaceably arranged therein a first valve body 11 coaxial to bore 10. At its side facing the filling and removing opening 5, the first valve body 11 has a sealing collar 12 which cooperates with the sealing disc 9 surrounding opening 5. To be more specific, valve body 11 is pressed together with its sealing collar 12 by a helical spring 13 against sealing disc 9. Helical spring 13 is indirectly supported on a shoulder 14 disposed opposite to filling and removing opening 5. Shoulder 14 is followed in axial direction by a second bore 15 of a smaller diameter which terminates in the interior of the container and whose end facing away from shoulder 14 has a conical valve seat 16 formed thereon. Five radially inwardly oriented webs 17 whose free ends 18 project into the cross section of the second bore 15 are arranged on shoulder 14. When viewed from the smaller bore 15, the free ends 18 taper to the larger bore Guide ribs 19 which extend in parallel with the bore axis are provided for the first valve body 11 on the edge of the larger bore 10. In the area of the shoulder these guide ribs 19 taper to the center of the bore, thereby forming a guide for the end of helical spring 13 which rests on webs 17.

The first valve body 11 has a tappet 20 which faces the second smaller bore 15 and is integral with the first valve body. Tappet 20 is surrounded by and in spaced-apart relationship with a collar 21 that faces shoulder 14 and pertains to the first valve body 11. Helical spring 13 is seated in the annular gap formed by tappet 20 in collar 21 and is supported on the gap bottom relative to the first valve body 11. In the closed position of the first valve body 11 as illustrated in FIG. 2, tappet 20 ends at some distance in front of webs 17. The distance is chosen such that a ball 22 whose diameter is slightly smaller than the diameter of the second bore 15, but greater than the clearance of the free ends 18 of webs 7 fits into the interspace.

The operation and function of the pressure container of the invention shall now be explained in more detail in the following: FIGS. 1 and 2 illustrate a state of the pressure container before the same is filled for the first time. The first valve body 11 is urged by spring 13 against seal 9, and the second valve body, i.e. ball 22, is still positioned in the large bore 10 in front of webs 17. When filling pin 23 is introduced through the filling and removing opening 5, it has a sealing effect with respect to sealing disc 9 and lifts the first valve body 11 relative to sealing disc 9. Fluid filled through the filling pin can now pass between valve body 11, sealing disc 9, then further through the annular gap formed between the larger bore 10 and the first valve body and then between webs 17 into the smaller bore 15 and from there into the interior of the container.

When the container is filled in this way, filling pin 23 or possibly another mandrel is further pushed into the filling opening, so that tappet 20 presses ball 22 positioned in front of webs 17 into the smaller second bore 15. This is possible for the reason that webs 17 consist of a softer material than ball 22, which is preferably made of steel or glass.

Whenever the contents is to be removed from the container, the first valve body 11 is again lifted from its seat through a mandrel. The pressurized container ball now tries to move through the smaller second bore 15 into the larger bore 10. Ball 22 which is now positioned in the smaller bore 15 is pressed from the rear side against the free ends 18 of webs 17. Ball 22 is centered due to the oblique construction of the free ends 18 of the webs, so that the exiting fluid evenly flows around the ball and into the larger bore to pass through the annular gap formed between the first valve body 11 and the wall of the large bore 10, and between sealing disc 9 and the lifted valve body 11 to the outside.

If somebody tried to refill the pressure container, which has possibly been damaged during its use, ball 22 which is actually positioned within the second bore 15 would move into the position outlined by a dash-dotted line and close the second bore 15 together with valve seat 16. Hence, a renewed filling of pressure container 1 is made impossible.

I claim:

1. A combined filling and removing valve for a disposable pressure container, comprising:

a. a first valve body within a valve housing having a first end and a second end; said first valve body having a generally cylindrical shape, said first valve body having a first valve body diameter, said first valve body having a sealing collar end and a tappet end;

b. a second valve body within said valve housing, said second valve body having a second valve body diameter;

c. a sealing disk adjacent said first end of said valve housing;

d. a helical spring within said valve housing; and e. said valve housing of unitary construction; said valve housing having an axis therethrough; said valve housing having a first axial bore therein extending from said fist end, said first axial bore having a first axial bore diameter; said valve housing having a second axial bore therein extending from said first axial bore, said second axial bore having a second axial bore diameter and a second axial bore circumference; said valve housing having a third axial bore therein extending from said second end, said third axial bore having a third axial bore diameter; said first axial bore and said second axial bore having a first intersection location; said second axial bore and said third axial bore having a second intersection location; said second intersection location defining a valve seat; said first axial bore diameter being greater than said second axial bore diameter, said second axial bore diameter being greater than said third axial bore diameter, said second valve body diameter being greater than said third axial bore diameter and less than said second axial bore diameter, said first valve body diameter being less than said first axial bore diameter; said valve housing having a surmountable and fluid-permeable barrier assembly, said barrier assembly being located internal to said valve housing at said first intersection location, said barrier assembly including a shoulder at said first intersection location, said shoulder having a plurality of radial inward projections extending therefrom, said plurality of projections having ends defining a projection circumference, said projection circumference being less than said second axial bore circumference;

f. said second valve body being movable from said first axial bore to said second axial bore of said valve housing; said helical spring disposed within said first axial bore of said valve housing; said first valve body disposed within said first axial bore of said valve housing; said helical spring engageable with said barrier assembly and said first valve body thereby urging said sealing collar end of said first valve body against said sealing disk.

2. The valve of claim 1, wherein said first valve body is movable from said sealing disk to a first position, thereby permitting the container to be filled with a fluid; said first valve body being further movable to a second position, whereby said tappet end of said first valve body engages said second valve body, said engagement pushes said second valve body from said first axial bore of said valve housing into said second axial bore of said valve housing, said second valve body and said valve seat forming a check valve prohibiting said container from being refilled; said barrier assembly retaining said second valve body within said second axial bore.

3. The valve of claim 1, wherein said plurality of radial inward projections define a plurality of radial webs, said plurality of radial inward projections extending from said shoulder being evenly distributed, said ends having an even spacing therebetween.

4. The valve of claim 3, wherein said ends of said projections have an inward taper from said second axial bore to said first axial bore, whereby said projection circumference has its least value at a location closest to said first valve body.

5. The valve of claim 1, wherein said second valve body is rotationally symmetrical.

6. The valve of claim 1, wherein said helical spring has an inside diameter, said helical spring inside diameter being slightly greater than said second valve body diameter, said second valve body being disposable within said helical spring disposed within said first axial bore of said valve housing.

7. The valve of claim 1, wherein said second valve body is a ball.

8. The valve of claim 1, wherein said second valve body is constructed of a first material, said valve housing being constructed of a second material, where said first material is a harder material than said second material, whereby said second valve body can be pushed from said first axial bore of said valve housing into said second axial bore of said valve housing.

9. The valve of claim 1, wherein said first valve body has a coaxial bore from said tappet end toward said sealing collar end, said coaxial bore having a coaxial bore diameter, said coaxial bore diameter being less than said first valve body diameter; said tappet end having a portion central to said coaxial bore forming a tappet and said tappet end having a portion external from said coaxial bore forming a collar; said helical spring being partway received by said coaxial bore.

10. The valve of claim 1, wherein said first valve body is made of a plastic material.

11. The valve of claim 1, wherein said valve housing is made of a plastic material.

12. The valve of claim 1, wherein said valve housing is manufactured by injection moulding.

13. The valve of claim 1, wherein said plurality of radial inward projections define a plurality of radial webs, said plurality of radial inward projections extending from said shoulder being evenly distributed, said ends having an even spacing therebetween; said ends of said projections having an inward taper from said second axial bore to said first axial bore, whereby said projection circumference has its least value at a location closest to said first valve body; said helical spring having an inside diameter, said helical spring inside diameter being slightly greater than said second valve body diameter, said second valve body being disposable within said helical spring disposed within said first axial bore of said valve housing; said second valve body being constructed of a first material, said valve housing being constructed of a second material, said first material being a harder material than said second material, whereby said second valve body can be pushed from said first axial bore of said valve housing into said second axial bore of said valve housing; said first valve body being movable from said sealing disk to a first position, thereby permitting the container to be filled with a fluid, said first valve body being further movable to a second position, whereby said tappet end of said first valve body engages said second valve body, said engagement pushes said second valve body from said first axial bore of said valve housing into said second axial bore of said valve housing, said second valve body and said valve seat forming a check valve prohibiting said container from being refilled, said barrier assembly retaining said second valve body within said second axial bore; and, said first valve body having a coaxial bore from said tappet end toward said sealing collar end, said coaxial bore having a coaxial bore diameter, said coaxial bore diameter being less than said first valve body diameter, said tappet end having a portion central to said coaxial bore forming a tappet and said tappet end having a portion external from said coaxial bore forming a collar, said helical spring being partway received by said coaxial bore.

14. The valve of claim 13, wherein said valve housing is made of a plastic material.

15. The valve of claim 13, wherein said first valve body is made of a plastic material.

16. The valve of claim 14, wherein said valve housing is manufactured by injection moulding.

17. The valve of claim 14, wherein said second valve body is a steel ball.

18. The valve of claim 14, wherein said second valve body is a glass ball.

19. A disposable pressure container, comprising:

a. a container having a container opening therein;

b. a cover, said cover being received by said container opening, said cover having a cover filling and removing opening therethrough; and, c. a combined filling and removing valve, said combined filling and removing valve being retained by said cover within said pressure container; said combined filling and removing valve having:

(1.) a first valve body within a valve housing having a first end and a second end; said first valve body having a generally cylindrical shape, said first valve body having a first valve body diameter, said first valve body having a sealing collar end and a tappet end;

(2.) a second valve body within said valve housing, said second valve body having a second valve body diameter;

(3. ) a sealing disk adjacent said first end of said valve housing, said sealing disk having a disk filling and removing opening therethrough, said sealing disk positioned at a location between said cover and said sealing collar end of said first valve body, said disk filling and removing opening and said cover filling and removing opening being in flow communication;

(4.) a helical spring within said valve housing; and (5.) said valve housing of unitary construction; said valve housing having an axis therethrough; said valve housing having a first axial bore therein extending from said first end, said first axial bore having a first axial bore diameter; said valve housing having a second axial bore therein extending from said first axial bore, said second axial bore having a second axial bore diameter and a second axial bore circumference; said valve housing having a third axial bore therein extending from said second end, said third axial bore having a third axial bore diameter; said first axial bore and said second axial bore having a first intersection location; said second axial bore and said third axial bore having a second intersection location; said second intersection location defining a valve seat; said first axial bore diameter being greater than said second axial bore diameter, said second axial bore diameter being greater than said third axial bore diameter, said second valve body diameter being greater than said third axial bore diameter and less than said second axial bore diameter, said first valve body diameter being less than said first axial bore diameter; said valve housing having a surmountable and fluid-permeable barrier assembly, said barrier assembly being located internal to said valve housing at said first intersection location, said barrier assembly having a shoulder at said first intersection location, said shoulder having a plurality of radial inward projections extending therefrom, said plurality of projections having ends defining a projection circumference, said projection circumference being less than said second axial bore circumference;

(6.) said second valve body being movable from said first axial bore to said second axial bore of said valve housing; said helical spring disposed within said first axial bore of said valve housing; said first valve body disposed within said first axial bore of said valve housing; said helical spring engageable with said barrier assembly and said first valve body thereby urging said sealing collar end of said first valve body against said sealing disk.

* * * * *

UNITED STATES PATENT AND TRADEMARK OFFICE

CERTIFICATE OF CORRECTION

PATENT NO. : 5,305,925

DATED : Apr. 26, 1994

INVENTOR(S) : Guenter M. Vogel, Munich, Fed. Rep. of Germany

It is certified that error appears in the above-indentified patent and that said Letters Patent is hereby corrected as shown below:

Column 3, line 15, after "bore" insert --10.--

Column 4, line 30, delete "fist" insert --first--

Signed and Sealed this

Fourth Day of October, 1994

Bruce Lehman

*Attest:*

BRUCE LEHMAN

*Attesting Officer*

*Commissioner of Patents and Trademarks*